United States Patent [19]

Ruf

[11] Patent Number: 5,035,233

[45] Date of Patent: Jul. 30, 1991

[54] ORTHOPAEDIC EXERCISE FRAME

[76] Inventor: Hermann Ruf, Pfützenstr. 45048, D-6103 Darmstadt-Griesheim, Fed. Rep. of Germany

[21] Appl. No.: 479,105

[22] Filed: Feb. 13, 1990

[30] Foreign Application Priority Data

Feb. 15, 1989 [DE] Fed. Rep. of Germany ..... 3904445

[51] Int. Cl.[5] ..... A63B 23/04

[52] U.S. Cl. ..... 128/25 B; 272/96; 272/144; 272/145

[58] Field of Search ..... 128/25 R, 25 B, 48, 128/49, 50, 363; 272/93, 96, 144, 145, DIG. 5

[56] References Cited

U.S. PATENT DOCUMENTS

| | | | |
|---|---|---|---|
| 4,603,687 | 8/1986 | Greenwood | 128/25 R |
| 4,621,620 | 11/1986 | Anderson | 128/25 R |
| 4,637,379 | 1/1987 | Saringer | 128/25 R |
| 4,834,073 | 5/1989 | Bledsoe et al. | 128/25 R |

*Primary Examiner*—Richard J. Apley
*Assistant Examiner*—Lynne A. Reichard
*Attorney, Agent, or Firm*—Herbert Dubno

[57] ABSTRACT

A motor-driven orthopaedic frame for the therapeutic exercise of the lower extremity of a patient has a chassis on which a carriage is slidable and which has a calf support portion and a foot support portion which can be pivoted about an axis transverse to the free sliding direction of the carriage on the latter. A threaded spindle serves to drive these supports about the respective axis for extension and flexure of the lower leg.

15 Claims, 5 Drawing Sheets

ORTHOPAEDIC EXERCISE FRAME

FIELD OF THE INVENTION

My present invention relates to a motor-driven orthopaedic exercise frame for the therapeutic exercise of the lower extremities and the hip joint.

BACKGROUND OF THE INVENTION

A large number of orthopaedic exercise frames are in use, these frames all have a substructure or chassis with a sliding carriage on which a calf support with a foot support is mounted. This carriage is moved by means of a motor-driven spindle. Extension and/or flexing of the leg is accomplished by moving the carriage backwards or forwards, the leg thus being correspondingly extended or flexed. It is also possible, irrespective of this motion, to provide additional active muscle training by having the foot support movable against a additional spring.

In order to attain anatomically correct extension and flexing of the leg in the machines known, it is necessary that the spindle, which is located in the substructure of the carriage, the chassis or the orthopaedic exercise frame have a length of at least 450 mm. The carriage must, therefore, be moved along the length of the spindle in order to achieve a motion of the leg, which permits anatomically correct treatment.

This long backwards and forwards movement causes very high loads on the components exposed to wear. The length of the spindle, furthermore, necessitates a correspondingly large substructure or chassis, which enlarges the orthopaedic exercise frame as a whole, not only its length, but also its weight. The high weight is a particular disadvantage for the staff operating the exercise frame since it is not possible to provide an orthopaedic exercise frame for every patient, so that the frame must, instead, be transported from bed to bed.

OBJECT OF THE INVENTION

It is an object of the invention to provide an orthopaedic exercise frame which is of compact, handy, light and robust design, and which functions with a relatively large motion with a shorter motion part on the spindle, and is thus less subject to wear.

Another object of my invention is to provide an improved orthopaedic exercise frame which overcomes drawbacks of the exercise frames provided heretofore.

SUMMARY OF THE INVENTION

These objects are attained with an orthopaedic exercise frame which has its carriage mounted so as to be readily shifted on its chassis, i.e. floatingly, and the calf support and foot support are pivotally connected to the carriage.

The pivoting of the calf support and foot support is effected by means of a spindle acting directly on the foot support. The calf support, complete with foot support, is mounted in such a way that it can be pivoted about an axis located on the carriage and is pivoted by a gear system installed on the carriage, which drives a nut running on the spindle via a gearwheel set.

By contrast with conventional constrictions, the carriage on this exercise aid is mounted on guide rails on the substructure in such a way that it can be freely moved. It is advantageous if the guide rails are downwardly sloped towards the torso of the patient, so that the deadweight of the carriage acts in a direction toward the patient and does not exercise tension on the leg.

The calf pad of the calf support is mounted on the laterally spaced rods of the calf support in such a way that it can be moved, so that correct support of the calf can be selected for each patient. The heel support, on the other hand, is fixed. In this way, the mechanical therapy developed by the exercise frame of the invention closely approximates manually applied exercise, since the foot is retained and the extremity is flexed by the exertion of pressure on the calf.

The invention ensures that no forced restraint is applied to the knee. Thanks to the freely moveable carriage, the knee always remains free of tensile and compressive loads and is able to assume the anatomically correct attitude to the thigh at every point in the motion. Furthermore, the freely moveable carriage means that muscle reflex training (voluntomotoricity) is achieved, which ensures to the maximum possible degree the exclusion of muscle fatigue and talipes equinus occurring with passive machines. The orthopaedic exercise frame of the invention thus achieves not only passive movement, but also an additional active muscle training.

In the exercise frame of the invention, flexing and/or extension of the extremity is achieved not be means of controlled backwards and forwards motion of the carriage as known in the conventional version, but, rather, by means of pivoting of the calf support and the foot support connected to it.

Pivoting is effected by means of a motor-driven nut running on the spindle acting on the underside of the foot support. This spindle nut shifts the spindle to the right or left and thus causes pivoting of the calf support foot support assembly connected to it, the assembly being mounted on a spindle of the carriage in such a way that it can pivot. The freely moveable carriage is automatically moved forwards or backwards, for the extension or flexing of the leg, causing the muscle reflex training already mentioned.

The frame can thus comprises:

a chassis;

a carriage freely slidable on the chassis in a longitudinal direction and dimensioned to receive a leg of a patient to be exercised on the frame;

a calf support on the carriage engageable beneath a calf portion of the leg;

a foot support on the carriage engageable beneath a foot portion of the leg; and means for pivotally mounting the calf support and the foot support on the carriage to enable pivotal motion of the calf and foot supports relative to the carriage for flexure and extension of the leg about a pivot axis transverse to the longitudinal direction.

Because of the unique drive of the invention, the orthopaedic exercise frame can be shorter, and thus lighter and more compact than earlier frames. For the same motion, the spindle nut in the orthopaedic exercise frame described by the invention needs to travel only 1/5 to ⅛ of the path of the spindle nut of a conventional orthopaedic exercise frame.

In this way, wear on those parts exposed to wear is reduced substantially, since the working speed of the components exposed to wear has also been reduced. The weight savings compared to conventional machinery can amount to some 35 to 40%.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
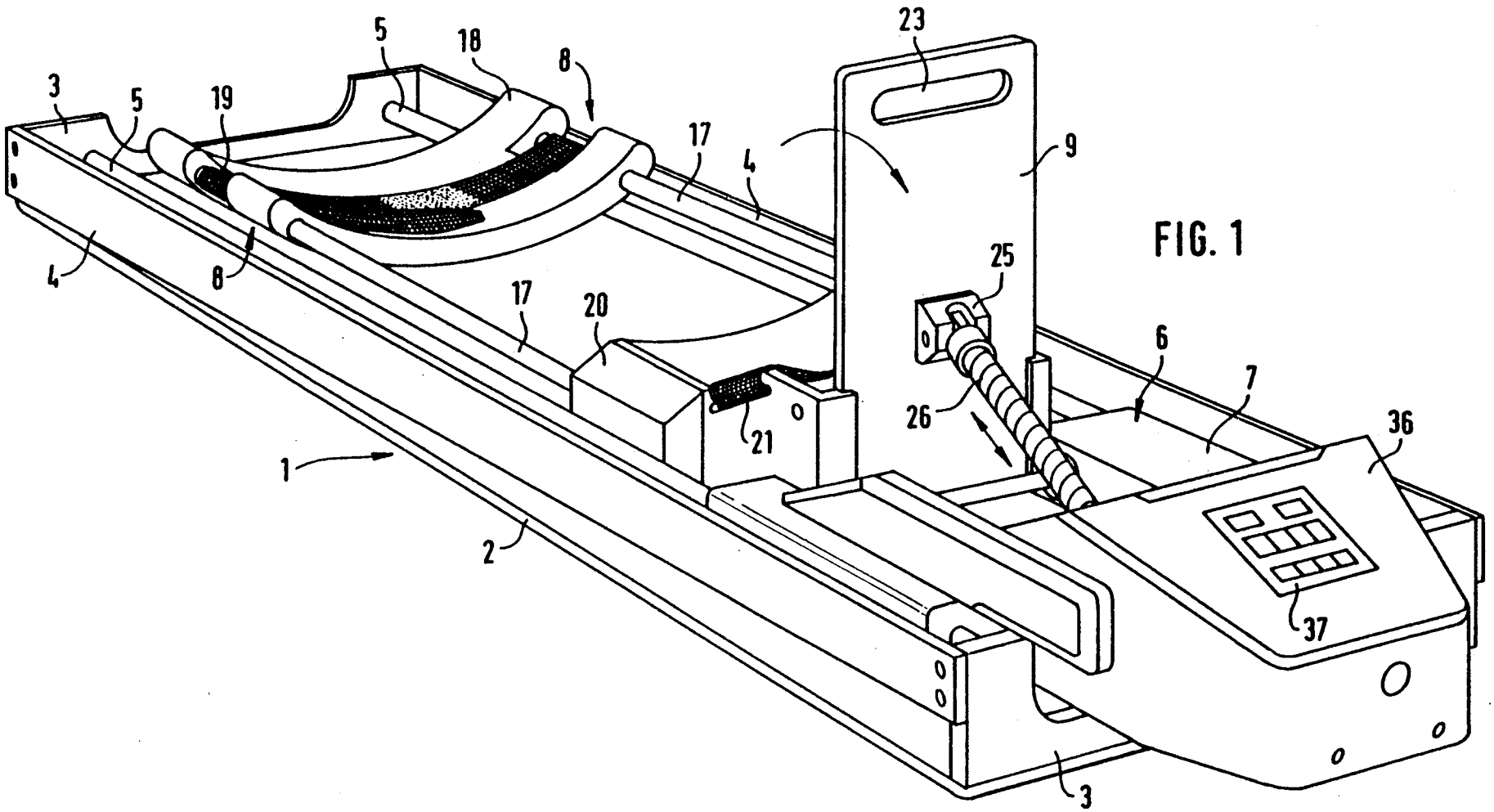
FIG. 1 is a perspective view of the orthopaedic exercise frame according to the invention.

FIG. 1 shows a perspective view of the orthopaedic exercises frame, the substructure or chassis 1 of which consists of a frame 2 having end components 3, side components 4 and guide rails 5 on which the carriage 6 is mounted so as to be freely moveable in a longitudinal direction.

Figure 5:
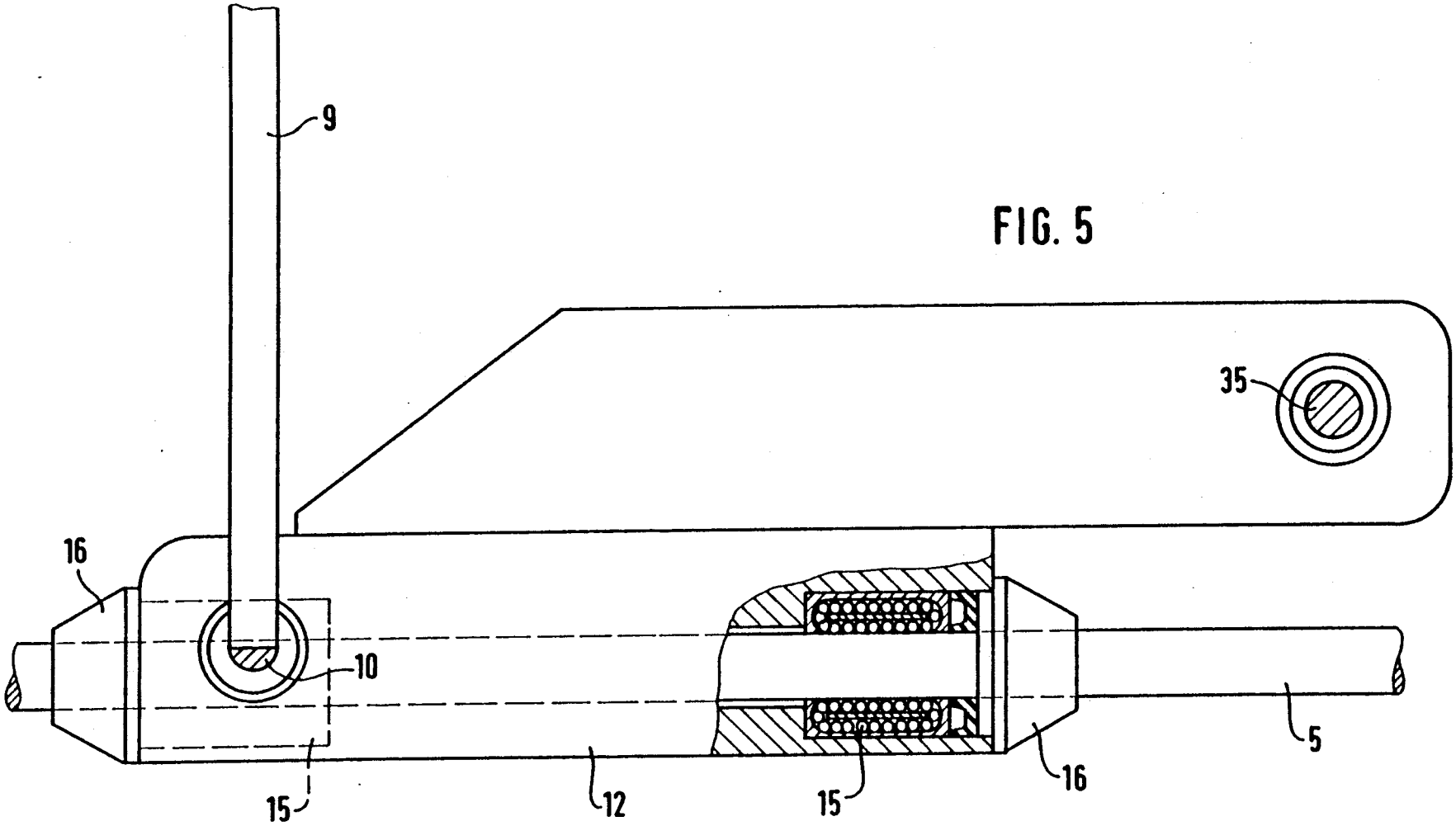
FIG. 5 is a detail view of the portion of a of FIG. 3 of the carriage on the guide rails.

The carriage 6 comprises a support component 7, which carries a spindle 10 (FIG. 2), about which a calf support 8 and a foot support 9 can be pivoted, and gear system 11 and guides 12 (FIG. 5), which slide by means of segmental bearings 15 on the guide rails. Two segmental bearings 15 and a stop plug 16 on both sides are provided for each guide rail 5.

Figure 2:
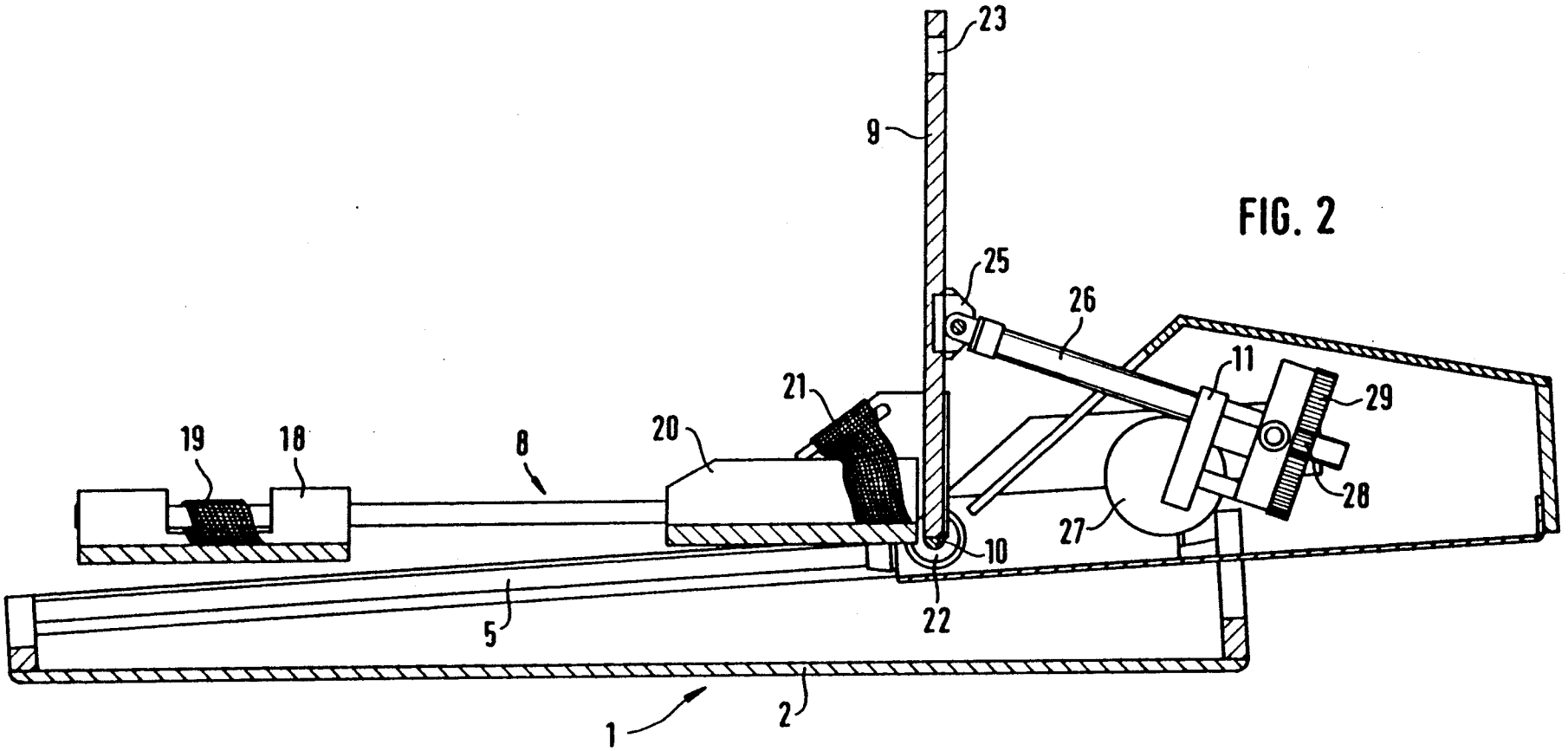
FIG. 2 is a longitudinal section through the orthopaedic exercise frame.
Figure 3:
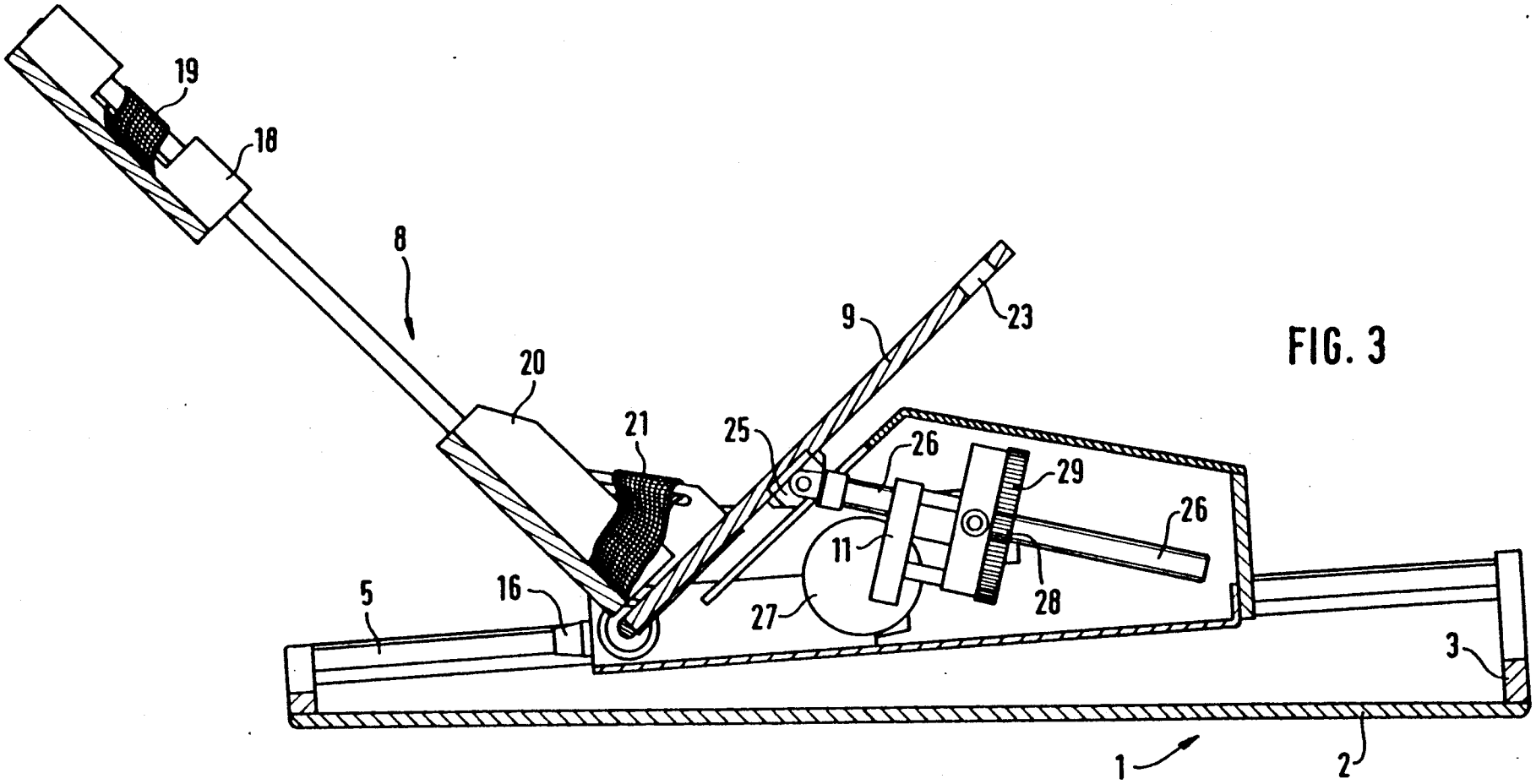
FIG. 3 is a longitudinal section through the orthopaedic exercise frame in its working position.

The calf support 8 and foot support 9 pivot through approximately 45° to 50° about axis 10 of carriage 6 and are mounted on it by means of ball bearings 22, as can be clearly seen from FIGS. 2 and 3, which show longitudinal sections through the orthopaedic exercise frame in its starting position, i.e. with the leg extended, and in its working position, i.e. with the leg flexed. The calf support 8 consists of two laterally spaced rails 17 (FIG. 1), on which the calf pad !8 is mounted in such a way that it can be moved, in order to permit adaptation to the calf height of any particular patient.

A VELCRO tape 19 is used for connection of the calf with the support 18. The rail ends facing away from the calf pad engage in the heel support 20 and are firmly connected to this. The heel support also provides the connection with the foot support. A VELCRO tape 21 secures contact of the heel with the foot support and ensures correct contact of the heel with component 20. The foot support features a carrying handle opening 23 at its free top end.

The underside of the foot support features a bearing pedestal 25 with or without roller bearings for accommodation of one end of a vertical threaded spindle 26. Spindle 26 is pivotally held in bearing pedestal 25 in order to permit its corrective movement upon pivoting of the calf support foot support assembly, as illustrated in FIGS. 2 and 3.

Figure 4:
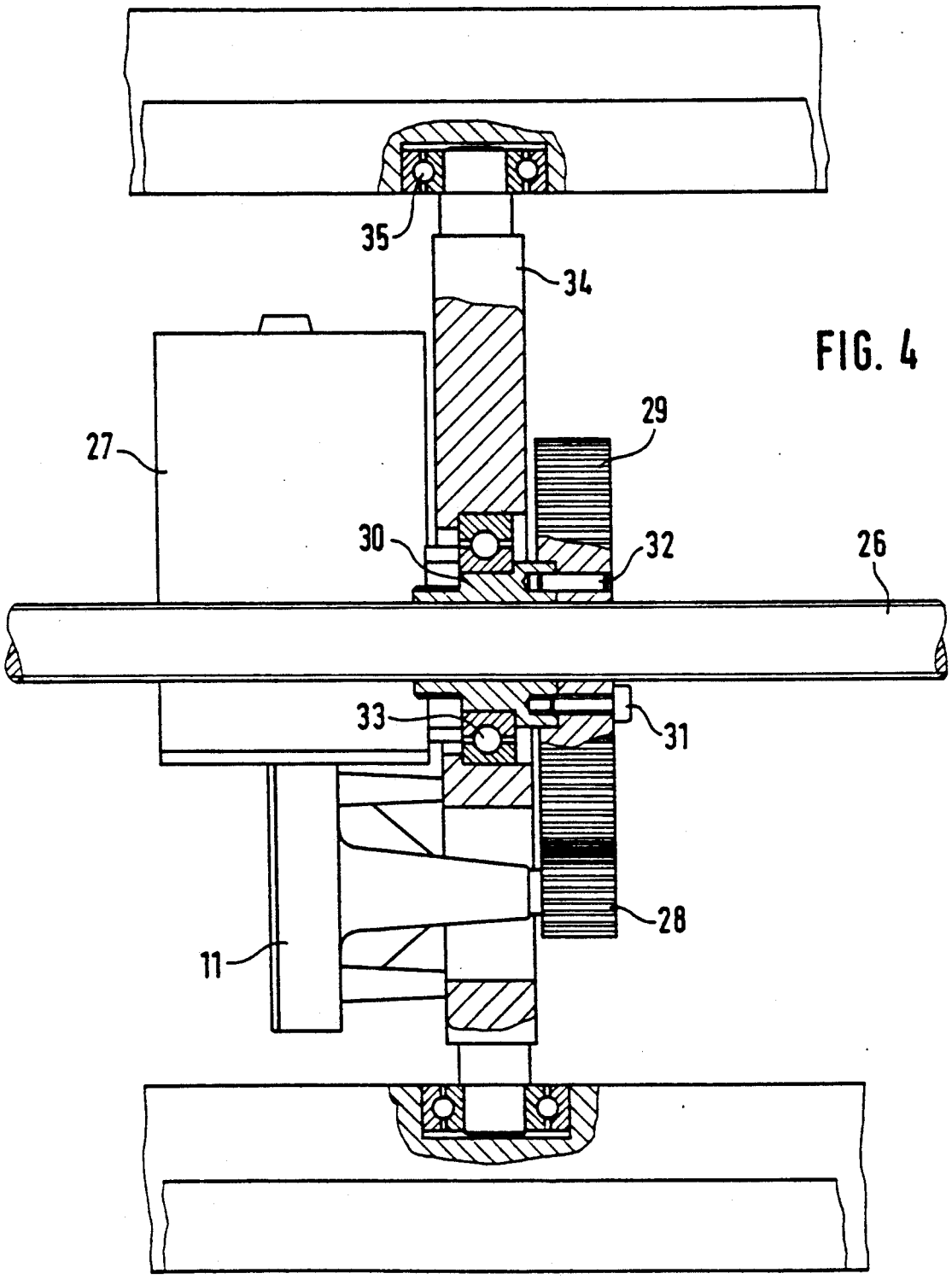
FIG. 4 is an enlarged, partially sectioned plan view of the drive gear system (detail b of FIG. 3)

The gear system II is explained on the basis of FIG. 4. The gear system 11 consists of gear motor 27, which drives gearwheel set 28, 29 and thus a spindle nut 30 via a transmission element. Drive gearwheel 28 driven by the motor 11 and its transmission, meshes with driven gearwheel 29, which is connected by a bolt 31 and/or pins 32 to spindle nut 30. Spindle nut 30 is, for its part, mounted by means of ball bearings 33 in the bearing spindle which, for its part, is located via pivot bearings 35 in support component 7. This support system permits, via the above-mentioned pivot, corrective motion of the spindle axis through 10° to 15°.

The cover of the support component is represented at 36 and the operating panel for the orthopaedic exercise frame is shown at 37.

As can be clearly seen from FIGS. 2 and 3, the preferably inductively hardened guide rails 5 for the carriage 6 are inclined downwardly toward the patient's torso in substructure 1, in such a way that the downward slope is toward the patient. This feature has proven advantageous, but is not absolutely necessary for the effectiveness of the machine.

The gearwheel set for drive of the spindle nut can be changed, and the transmission ratio of the gear system thus adapted to requirements. Driven gearwheel 29 should preferably be made of plastic, while the spindle nut can consist of bronze. Spindle nut 13 and the driven gearwheel 29 can, however, also be made in one piece in plastic. The drive gearwheel 28 consists of steel or a nonferrous metal. The latter may also be made of plastic, but should not be of the same material quality as the driven gearwheel 29 so that the two wheels do not have identical rates of wear.

When the orthopaedic exercise frame is in use, the lower extremity of the patient must be placed on the calf support, the calf pad adjusted correspondingly, and the calf of the patient secured on the support by means of the two VELCRO tapes 19 and 21. When the frame is switched on, the calf support foot support assembly is pivoted by means of adjustment of spindle 26 in the direction of the arrow as shown in FIG. 1 and the carriage moved backward or forwards for flexing (FIG. 3) or extension (FIG. 2) of the calf.

I claim:

1. An orthopaedic exercise frame which comprises:

a chassis;

a nondriven carriage freely slidable on said chassis in a longitudinal direction and dimensioned to receive a leg of a patient to be exercised on the frame;

a calf support on said carriage engageable beneath a calf portion of said leg;

a foot support on said carriage engageable beneath a foot portion of said leg;

means for pivotally mounting said calf support and said foot support on said carriage to enable pivotal motion of said calf and foot supports relative to said carriage for flexure and extension of said leg about a pivot axis transverse to said longitudinal direction;

a threaded spindle on said carriage directly connected with said foot support; and a drive on said carriage for rotating said threaded spindle and effecting said pivotal motion of said calf and foot supports relative to said carriage for flexure and extension of said leg about said pivot axis.

2. An orthopaedic exercise frame which comprises:

a chassis;

a carriage freely slidable on said chassis in a longitudinal direction and dimensioned to receive a leg of a patient to be exercised on the frame;

a calf support on said carriage engageable beneath a calf portion of said leg;

a foot support on said carriage engageable beneath a foot portion of said leg;

means for pivotally mounting said calf support and said foot support on said carriage to enable pivotal motion of said calf and foot supports relative to enable pivotal motion of said calf and foot supports relative to said carriage for flexure and extension of said leg about a pivot axis transverse to said longitudinal direction;

a threaded spindle operatively connected with said calf and foot supports; and a drive for said threaded spindle effecting said pivotal motion of said calf and foot supports relative to said carriage for flexure and extension of said leg about said pivot axis, wherein said pivot axis being defined by a pivot shaft journaled on said carriage wherein said pivot axis being defined by a pivot shaft journaled on said carriage said threaded spindle acting upon said shaft.

3. An orthopaedic exercise from which comprises:

a chassis;

a carriage freely slidable on said chassis in a longitudinal direction and dimensioned to receive a leg of a patient to be exercised on the frame;

a calf support on said carriage engageable beneath a calf portion of said leg;

a foot support on said carriage engageable beneath a foot portion of said leg;

means for pivotally mounting said calf support and said foot support on said carriage to enable pivotal motion of said calf and foot supports relative to said carriage for flexure and extension of said leg about a pivot axis transverse to said longitudinal direction;

a threaded spindle operatively connected with said calf and foot supports; and a drive for said threaded spindle effecting said pivotal motion of said calf and foot supports relative to said carriage for flexure and extension of said leg about said pivot axis, wherein said pivot axis being defined by a pivot shaft journaled on said carriage wherein said pivot axis being defined by a pivot shaft journaled on said carriage said threaded spindle being articulated to said foot support.

4. An orthopaedic exercise frame which comprises:

a chassis;

a carriage freely slidable on said chassis in a longitudinal direction and dimensioned to receive a leg of a patient to be exercised on the frame;

a calf support on said carriage engageable beneath a calf portion of said leg;

a foot support on said carriage engageable beneath a foot portion of said leg;

means for pivotally mounting said calf support and said foot support on said carriage to enable pivotal motion of said calf and foot supports relative to said carriage for flexure and extension of said leg about a pivot axis transverse to said longitudinal direction;

a threaded spindle operatively connected with said calf and foot supports; and a drive for said threaded spindle effecting said pivotal motion of said calf and foot supports relative to said carriage for flexure and extension of said leg about said pivot axis, said pivot axis being defined by a pivot shaft journaled on said carriage, said drive comprising:

a spindle nut threadedly engaging said spindle and rotatable thereon to advance and retract said spindle;

an electric motor; and a gear-wheel set operatively connecting said motor and said spindle nut to drive said spindle nut with said motor.

5. The orthopaedic exercise frame defined in claim 4 wherein said gear-wheel set is replaceable in said drive.

6. The orthopaedic exercise frame defined in claim 4 wherein said gear-wheel set includes at least one replaceable gear wheel.

7. The orthopaedic exercise frame defined in claim 4 wherein said nut is bolted to a gear wheel of said gear-wheel set.

8. The orthopaedic exercise frame defined in claim 4 wherein said nut is formed in one piece with a gear wheel of said gear-wheel set.

9. The orthopaedic exercise frame defined in claim 4 wherein said gear-wheel set comprises a driven gear wheel and said driven gear wheel consists of a plastic and said nut is composed of a metal or a metal alloy.

10. The orthopaedic exercise frame defined in claim 4 wherein said nut is composed of steel or a nonferrous metal.

11. The orthopaedic exercise frame defined in claim 4 wherein said chassis further comprises:

guide rails extending in said direction, said carriage riding on said guide rails.

12. The orthopaedic exercise frame defined in claim wherein said guide rails are inductively-hardened guide rails.

13. The orthopaedic exercise frame defined in claim 12, further comprising:

respective guides on said carriage engaging said guide rails, said guides being formed with segmental bearings.

14. The orthopaedic exercise frame defined in claim 12 wherein said guide rails slope downwardly toward a torso of the patient.

15. An orthopaedic exercise frame which comprises:

a chassis;

a nondriven carriage freely slidable on said chassis in a longitudinal direction and dimensioned to receive a leg of a patient to be exercised on the frame;

a calf support on said carriage engageable beneath a calf portion of said leg;

a foot support on said carriage engageable beneath a foot portion of said leg;

means for pivotally mounting said calf support and said foot support on said carriage to enable pivotal motion of said calf and foot supports relative to said carriage for flexure and extension of said leg about a pivot axis transverse to said longitudinal direction; and a drive on said carriage for effecting said pivotal motion of said calf and foot supports relative to said carriage for flexure and extension of said leg about said pivot axis.

* * * * *